US009834016B2

(12) United States Patent
Watanabe

(10) Patent No.: US 9,834,016 B2
(45) Date of Patent: Dec. 5, 2017

(54) MEDIUM HOLDER AND LIQUID EJECTING APPARATUS

(71) Applicant: SEIKO EPSON CORPORATION, Tokyo (JP)

(72) Inventor: Yoshihiro Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/453,503

(22) Filed: Mar. 8, 2017

(65) Prior Publication Data

US 2017/0259593 A1 Sep. 14, 2017

(30) Foreign Application Priority Data

Mar. 9, 2016 (JP) ..... 2016-045570

(51) Int. Cl.

| | |
|---|---|
| ***B41J 15/04*** | (2006.01) |
| ***B65H 16/06*** | (2006.01) |
| ***B41J 15/02*** | (2006.01) |
| ***B41J 2/01*** | (2006.01) |

(52) U.S. Cl.

CPC ..... *B41J 15/02* (2013.01); *B41J 2/01* (2013.01); *B41J 15/042* (2013.01); *B65H 16/06* (2013.01)

(58) Field of Classification Search

CPC ..... B65H 16/02; B65H 16/06; B41J 15/02; B41J 15/04

See application file for complete search history.

(56) References Cited

U.S. PATENT DOCUMENTS 8,870,366 B2 * 10/2014 Akatsu ..... B41J 11/00 347/104
2008/0277851 A1 * 11/2008 Genta ..... B41J 15/042 269/56

FOREIGN PATENT DOCUMENTS

| | | |
|---|---|---|
| JP | 2004-181823 A | 7/2004 |
| JP | 2005-187199 A | 7/2005 |
| JP | 2009-023171 A | 2/2009 |

* cited by examiner

*Primary Examiner* — Huan Tran
(74) *Attorney, Agent, or Firm* — Foley & Lardner LLP

(57) ABSTRACT

A medium holder according to the invention includes a medium roll being a wound medium, and a medium holder unit that is mounted onto an end portion of the medium roll in an axial direction. The medium holder unit includes a movement mechanism having a rotating body that moves the medium roll.

18 Claims, 13 Drawing Sheets

MEDIUM HOLDER AND LIQUID EJECTING APPARATUS

BACKGROUND

1. Technical Field

The present invention relates to a liquid ejecting apparatus, and technology for holding and handling a medium thereof.

2. Related Art

In a liquid ejecting apparatus such as an ink jet printer, medium may be pulled out from a medium roll that is the wound medium, and the medium then used. When utilizing a medium roll, as in JP-A-2009-23171, for example, a support member (adapter) is mounted onto an end portion of the medium roll in an axial direction. The medium roll is attached to the liquid ejecting apparatus through the support member. In such a liquid ejecting apparatus, medium is pulled out from the medium roll and transported, and a liquid such as ink is ejected from a liquid ejecting head, so that printing is performed on the medium.

SUMMARY

In recent years, the medium roll has been increasing in size and the medium roll itself has become increasingly heavy. Accordingly, the heavier the medium roll becomes, the greater the burden placed on a worker during handling or replacement operations, or the like, of the medium roll. For example, hitherto, such heavy medium rolls have been directly lifted and handled by a worker, or have been handled by moving on a cart. In a handling operation of a medium roll, greater effort is required as the medium roll becomes heavier, and the burden on the worker significantly increases as well. An advantage of some aspects of the invention is that worker effort for handling a medium roll is reduced.

A medium holder according to an aspect of the invention includes a medium roll being a wound medium, and a medium holder unit that is mounted onto an end portion of the medium roll in an axial direction. The medium holder unit includes a movement mechanism having a rotating body that moves the medium roll. According to the above configuration, the medium holder unit includes the movement mechanism having the rotating body that moves the medium roll, thus enabling the medium holder to stand by itself on, for example, a floor and be moved in this state across the floor, using the rotating body of the movement mechanism. A worker can therefore easily move the medium holder without using a cart, enabling worker effort for handling the medium roll to be greatly reduced.

It is preferable that the movement mechanism includes the rotating body provided at a position at which the rotating body moves the medium roll in at least one of a direction intersecting the axial direction of the medium roll and a direction along the axial direction. According to the above configuration, the medium roll can be moved in at least one of the direction intersecting the axial direction of the medium roll and the direction along the axial direction.

It is preferable that the rotating body is provided to at least one of an end face and a side face of the medium holder unit. According to the above configuration, a rotating body provided to the end face of the medium holder unit enables the medium roll to be moved in the direction intersecting the axial direction of the medium roll, and a rotating body provided to the side face of the medium holder unit enables the medium roll to be moved in the direction along the axial direction.

It is preferable that the movement mechanism is provided with a lock mechanism that locks the rotating body. According to the above configuration, the rotating body is locked by the lock mechanism, enabling movement of the medium holder to be restricted.

It is preferable that the lock mechanism locks the rotating body when the medium holder receives an impact force of a specific threshold value or greater. According to the above configuration, the rotating body is locked when the medium holder receives an impact force of the specific threshold value or greater, enabling movement to be restricted when the medium holder has fallen over, for example, and so safety can be increased.

It is preferable that the medium holder further includes a cover that covers the medium roll, and that the cover is housed in the medium holder unit. According to the above configuration, the cover can be taken out from the medium holder unit so as to cover the medium roll during handling or storage. The cover can also be housed in the medium holder unit when mounting the medium holder in a liquid ejecting apparatus.

It is preferable that the medium holder further includes a coupling member that couples together medium holder units mounted onto each of plural of medium rolls. According to the above configuration, plural medium holders can be moved at once while in a coupled state.

It is preferable that the rotating body is configured from a shock absorbing material. According to the above configuration, the rotating body is configured from a shock absorbing material, enabling an impact when the medium holder falls over, for example, to be softened.

It is preferable that the rotating body is provided through a shock absorbing mechanism. According to the above configuration, the rotating body is provided through a shock absorbing mechanism, enabling an impact when the medium holder falls over, for example, to be softened.

A liquid ejecting apparatus according to another aspect of the invention includes a medium mounting portion onto which the medium holder according to the above aspect is mounted, a transport mechanism that pulls the medium out from the medium holder and transports the medium, and a liquid ejecting head that ejects a liquid onto the medium transported by the transport mechanism. The liquid ejecting apparatus is, for example, a printer that ejects ink onto a medium such as printing paper; however, the liquid ejecting apparatus according to an aspect of the invention is not limited to printing applications.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
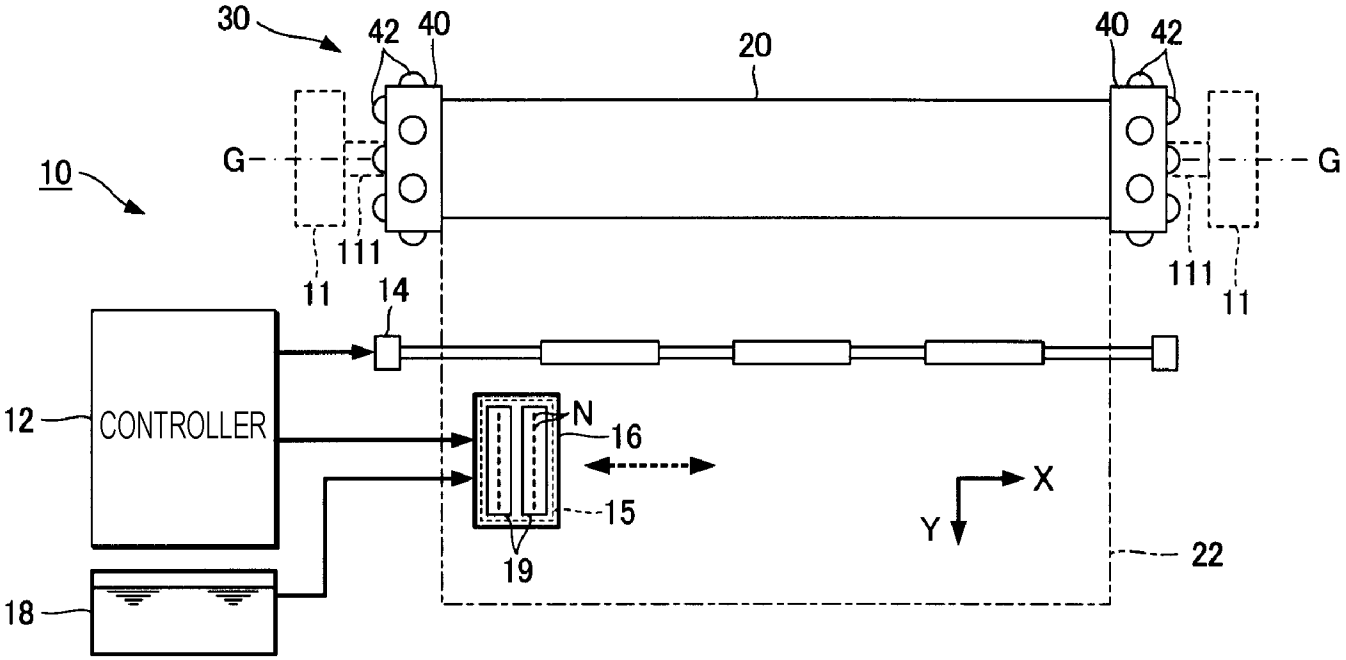
FIG. 1 is a configuration diagram of a liquid ejecting apparatus according to a first embodiment.

FIG. 1 is a diagram illustrating partial configuration of a liquid ejecting apparatus 10 according to a first embodiment of the invention. The liquid ejecting apparatus 10 of the first embodiment is an ink jet printing apparatus in which medium 22 is pulled out from a medium roll 20 that is the medium 22 having been wound into a roll shape, and ink, this being an example of a liquid, is ejected onto the medium. The liquid ejecting apparatus 10 illustrated in FIG. 1 is equipped with a controller 12, a transport mechanism 14, a liquid ejecting unit 15, and a carriage 16. A liquid container (cartridge) 18 that stores ink is mounted on the liquid ejecting apparatus 10. Ink is supplied from the liquid container 18 to the liquid ejecting unit 15.

The controller 12 performs overall control of respective elements of the liquid ejecting apparatus 10. Under control of the controller 12, the transport mechanism 14 pulls the medium 22 out from the medium roll 20 and transports the medium 22 along a Y direction. The liquid ejecting unit 15 is equipped with plural liquid ejecting heads 19. Under the control of the controller 12, each of the liquid ejecting heads 19 ejects ink from plural respective nozzles N onto the medium 22. Each of the liquid ejecting heads 19 includes plural groups of pressure chambers and piezoelectric elements (not illustrated in the drawings) that correspond to different nozzles N. By supplying drive signals that cause the piezoelectric elements to vibrate such that pressure inside the pressure chambers fluctuates, ink loaded inside the pressure chambers is ejected from the respective nozzles N.

The carriage 16 is installed with the liquid ejecting unit 15. The controller 12 moves the carriage 16 to and fro along an X direction intersecting the Y direction. In parallel with the transportation of the medium 22 by the transport mechanism 14 and the repeated to and fro movement of the carriage 16, the liquid ejecting heads 19 eject ink onto the medium 22 such that a desired image is formed on a surface of the medium 22. Note that, for example, it is possible for the carriage 16 to be equipped with plural liquid ejecting units 15 that eject different types of ink. A cutter, not illustrated in the drawings, is provided to the liquid ejecting apparatus 10. After printing, the medium 22 is cut by the cutter and discharged to a discharge tray, not illustrated in the drawings.

The medium roll 20 is mounted on a medium mounting portion 11 provided in the liquid ejecting apparatus 10. Medium holder units 40 are mounted onto the medium roll 20 of the present embodiment at each of two respective end portions 21 along a G-G axial line direction, the G-G axial line direction being the axial line of the medium roll 20. The medium holder units 40 and the medium roll 20 configure a medium holder 30. A support shaft (spindle) 111 is provided to each medium mounting portion 11. The medium roll 20 is rotatably mounted through the medium holder units 40 onto the support shafts 111.

In recent years, the medium roll 20 has been increasing in size and the medium roll 20 itself has become increasingly heavy. Accordingly, the heavier the medium roll 20 becomes, the greater the burden placed on a worker during handling or replacement operations, or the like, of the medium roll 20. In the present embodiment, movement mechanisms 42 are provided to the medium holder units 40 of the medium holder 30 such that the medium roll 20 can be handled without a cart. Namely, the medium holder 30 can be handled while the medium holder units 40 are mounted to the medium roll 20.

Figure 2:
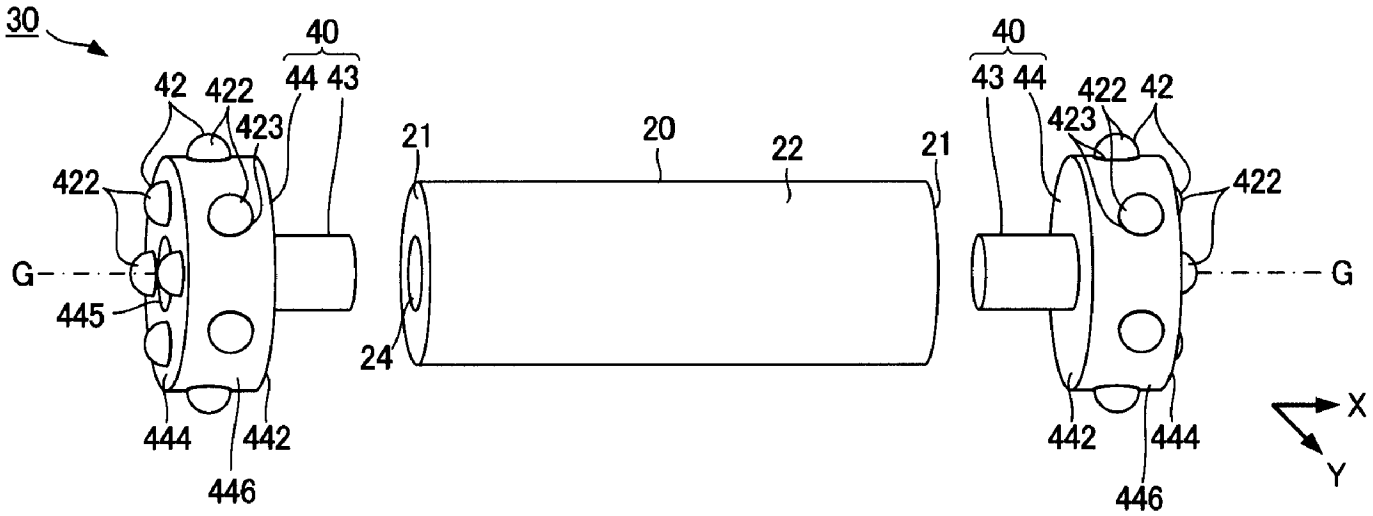
FIG. 2 is an exploded perspective view of a medium holder.
Figure 3:
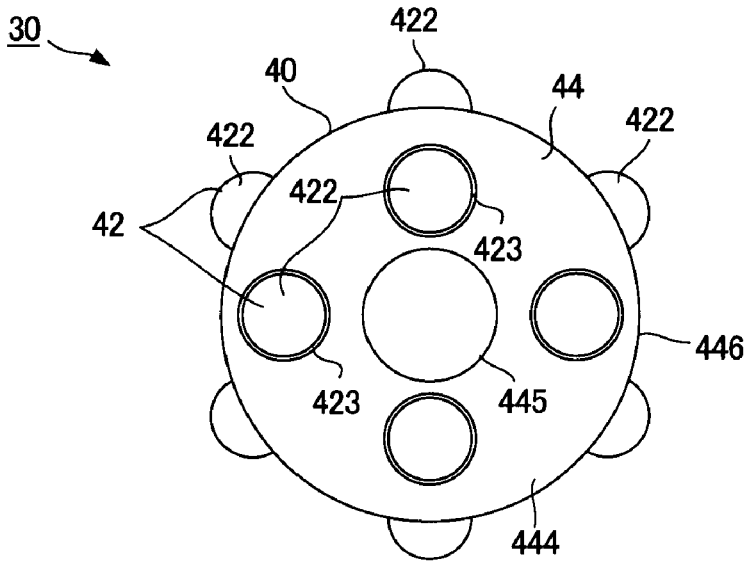
FIG. 3 is a diagram of the medium holder of FIG. 2, as viewed along an axial direction.

FIG. 2 is an exploded perspective view illustrating configuration of the medium holder 30 according to the present embodiment. FIG. 3 is a diagram of the medium holder 30, as viewed along the G-G axial line direction. As illustrated in FIG. 2 and FIG. 3, the medium holder 30 is configured by the medium roll 20 and two medium holder units 40. The two medium holder units 40 are mounted onto the two respective end portions 21 of the medium roll 20. The medium roll 20 is formed by winding the medium 22 into a roll shape about a hollow shaft (winding core) 24.

As the two medium holder units 40 illustrated in FIG. 2 have similar configuration to each other, in the following, explanation is given using the medium holder unit 40 on the minus side in the X direction as an example. The medium holder unit (adapter) 40 includes a shaft portion 43 that is inserted into the hollow shaft 24 of the medium roll 20 and a flange portion 44. The flange portion 44 is in the shape of a bottomed cylinder, and includes an end face (first end face) 442 on the side of the medium roll 20, an end face (second end face) 444 on the opposite side to the end face 442, and a side face (circumferential face) 446. The shaft portion 43 projects out from the end face 442 of the flange portion 44.

The shaft portion 43 is fitted into the hollow shaft 24 of the medium roll 20 to mount the flange portion 44 onto the end portion 21 of the medium roll 20. The outer diameter of the flange portion 44 is larger than the outer diameter of the medium roll 20. As illustrated in FIG. 3, the end face 444 of the flange portion 44 is provided with a shaft hole 445 into which the support shaft 111 of the respective medium mounting portion 11 described above is inserted.

As illustrated in FIG. 2 and FIG. 3, a movement mechanism 42 is provided to the medium holder unit 40 of the present embodiment. The movement mechanism 42 of the present embodiment includes plural rotating bodies 422 provided at positions at which the rotating bodies 422 move the medium roll 20 in a direction intersecting the G-G axial line direction of the medium roll 20 (a movement direction in a vertical orientation), and plural rotating bodies 422 provided at positions at which the rotating bodies 422 move the medium roll 20 in a direction along the G-G axial line direction (a movement direction in a horizontal orientation).

In the present embodiment, four of the rotating bodies 422 are provided to the end face 444 of the flange portion 44 such that they project out from the end face 444. The rotating bodies 422 of the end face 444 are disposed surrounding the shaft hole 445 at evenly spaced intervals. Each of the rotating bodies 422 is rotatably supported by a support body 423 provided to the end face 444. Six of the rotating bodies 422 are provided to the side face 446 of the flange portion 44 such that they project out from the side face 446. The rotating bodies 422 of the side face 446 are disposed at evenly spaced around the circumferential direction of the side face 446. However, the number and arrangement of the rotating bodies 422 are not limited thereto.

The rotating bodies 422 of the present embodiment are spherically shaped rollers. Each of the rotating bodies 422 is rotatably supported by a respective support body 423 provided to the side face 446. However, the rotating bodies 422 are not limited to spherically shaped rollers, and may be circular column shaped rollers. The rotating bodies 422 are not limited to rollers, and may be casters or the like. Each of the rotating bodies 422 is configured from a shock absorbing material such as a rubber or an elastomer. An impact when the medium holder 30 falls over, for example, can thereby be softened, and so the medium roll 20 itself is able to be protected, and damage imparted to an object or person struck by the medium holder 30 in a fall can be reduced. Note that a shock absorbing mechanism (a damping mechanism) such as rubber or a spring may be provided to the support bodies 423 of the rotating bodies 422. For example, impact when the medium holder 30 falls can also be softened by mounting the rotating bodies 422 to the respective support bodies 423 through a spring. A boundary portion between the end face 444 and the side face 446 of each flange portion 44 may also be provided with a corner protector configured from a shock absorbing material such as a rubber or an elastomer.

Figure 4:
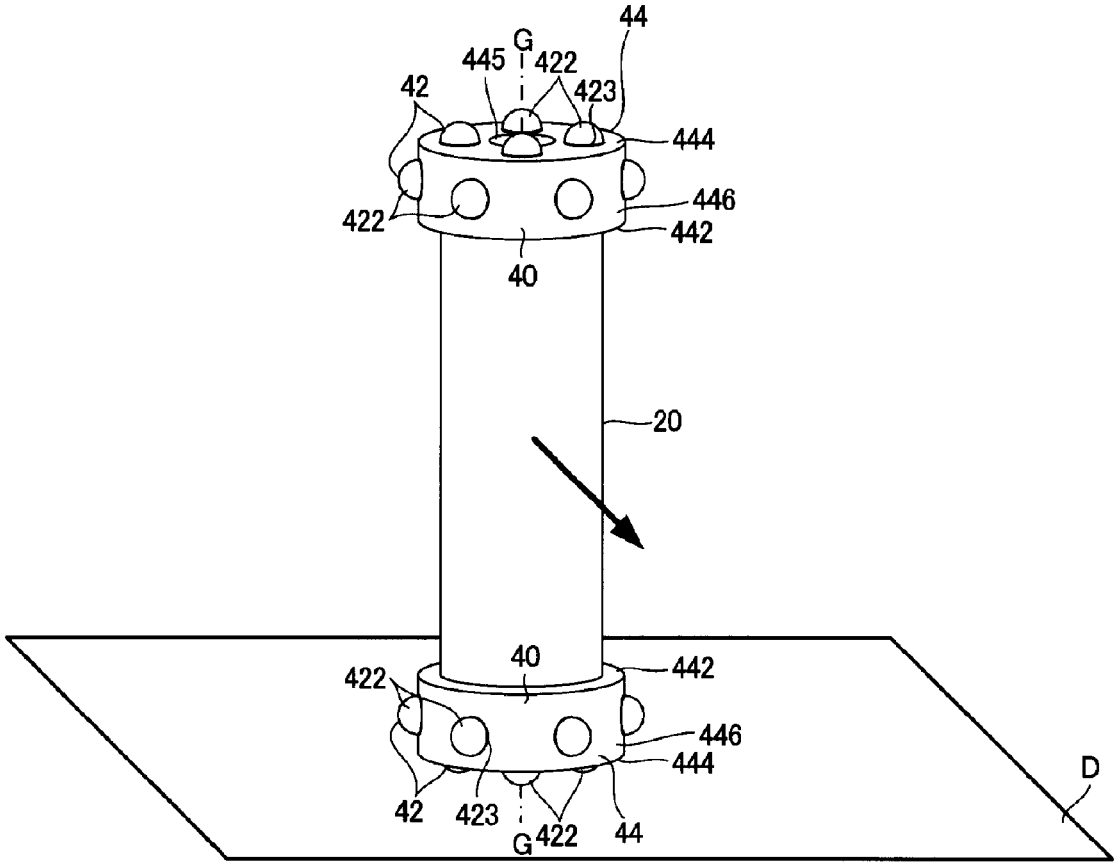
FIG. 4 is a diagram explaining operation when a medium holder is handled in a vertical orientation.
Figure 5:
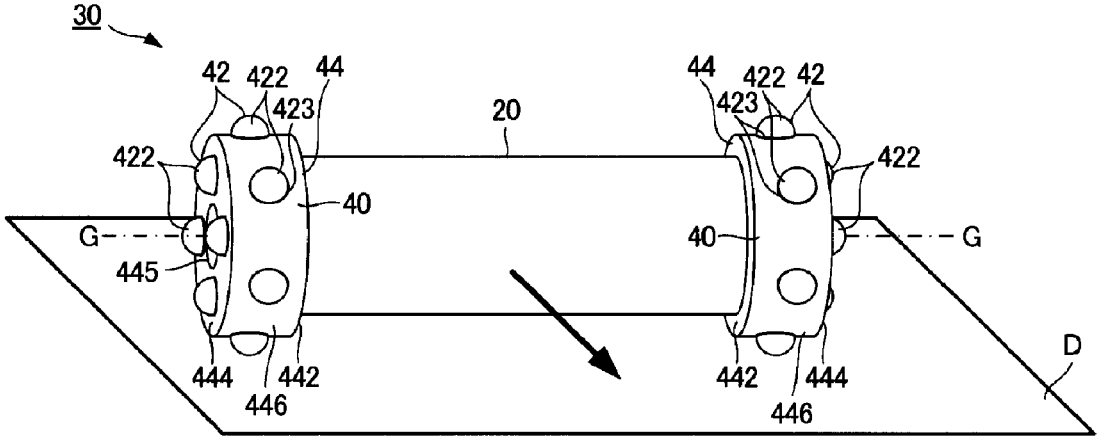
FIG. 5 is a diagram explaining operation when a medium holder is handled in a horizontal orientation.

FIG. 4 and FIG. 5 are explanatory diagrams of operations during handling the medium holder 30 according to the present embodiment. FIG. 4 is a case in which the medium holder 30 is handled in a vertically oriented state, and FIG. 5 is a case in which the medium holder 30 is handled in a horizontally oriented state. As illustrated in FIG. 4, when the medium holder 30 according to the present embodiment is vertically oriented, with its G-G axial line in a direction perpendicular to a floor D, the rotating bodies 422 of the end face 444 of the flange portion 44 abut the floor D. The medium holder 30 can therefore stand by itself in a vertical orientation. In this vertically oriented state, the medium holder 30 can be easily moved across the floor D. When the medium holder 30 according to the present embodiment is horizontally oriented, with its G-G axial line in a direction along the floor D, the rotating bodies 422 of the side face 446 of the flange portions 44 abut the floor D. The medium holder 30 can therefore stand by itself in a horizontal orientation, and in this horizontally orientated state, the medium holder 30 can be easily moved across the floor D.

Thus, according to the present embodiment, the medium holder 30 can stand by itself whether vertically oriented or horizontally oriented, thus facilitating storage and the like of the medium holder 30. Moreover, whether vertically oriented or horizontally oriented, the medium holder 30 can be moved across a floor D in that state. A worker can therefore easily move the medium holder 30 without using a cart, enabling worker effort for handling the medium roll 20 to be greatly reduced. Moreover, since the shaft hole 445 is formed in the medium holder unit 40, the medium holder unit 40 can be mounted on the support shaft 111 of the respective medium mounting portion 11 in a state in which the medium holder unit 40 has been mounted onto the medium roll 20. This enables not only burden in handling operations of the medium roll 20, but also burden in replacement operations, to be reduced. In cases in which the medium holder 30 is vertically oriented, the placement area of the medium holder 30 is able to be reduced compared to cases in which the medium holder 30 is horizontally oriented.

In the first embodiment, although an example has been given of a case in which the rotating bodies 422 are provided to both the end face 444 and the side face 446 of the flange portion 44, there is no limitation thereto, and for example, configuration may be made in which the rotating bodies 422 are provided to one out of the end face 444 and the side face 446 of the flange portion 44 as in the first modified example to the fourth modified example illustrated below. Note that in the respective modified examples, elements having similar operation or functionality as those already described use the reference numerals as those employed in the explanations of FIG. 2 to FIG. 5, and respective detailed explanation thereof is omitted as appropriate.

Figure 6:
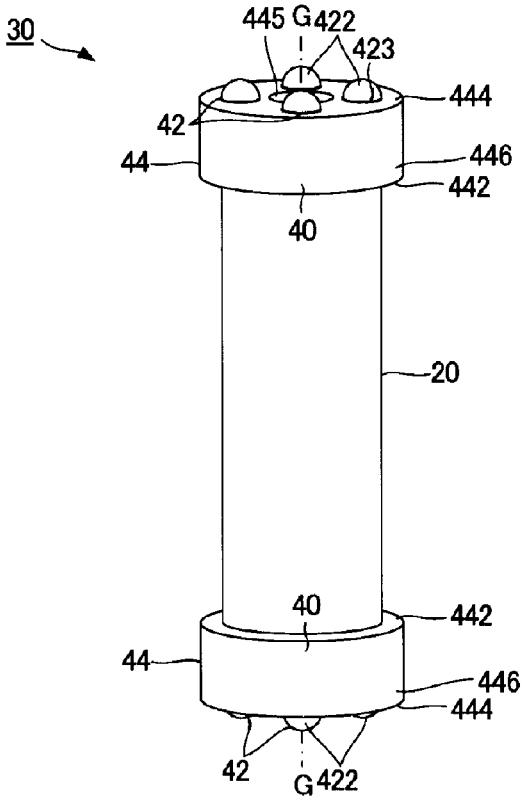
FIG. 6 is an external perspective view illustrating configuration of a medium holder according to a first modified example of the first embodiment.
Figure 7:
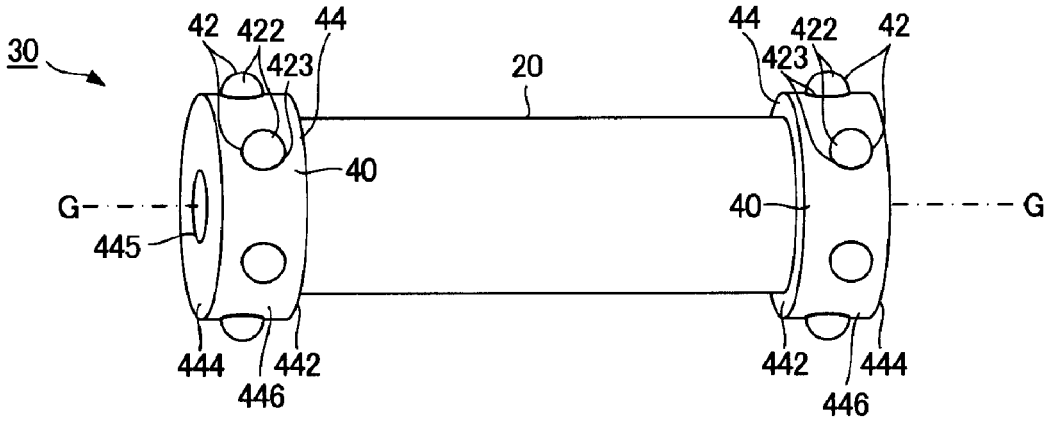
FIG. 7 is an external perspective view illustrating configuration of a medium holder according to a second modified example of the first embodiment.

For example, FIG. 6 is an external perspective view illustrating configuration of a medium holder 30 according to a first modified example of the first embodiment. The medium holder 30 of FIG. 6 is a member in which rotating bodies 422 are only provided to the end face 444 of the flange portion 44. According to the first modified example, the medium holder 30 can stand by itself in a vertical orientation, and the medium holder 30 can be moved in this vertically oriented state. FIG. 7 is an external perspective view illustrating configuration of a medium holder 30 according to a second modified example of the first embodiment. The medium holder 30 of FIG. 7 is a member in which rotating bodies 422 are only provided to the side face 446 of the flange portion 44. According to the second modified example, the medium holder 30 can stand by itself in a horizontal orientation, and the medium holder 30 can be moved in this horizontally orientated state.

Figure 8:
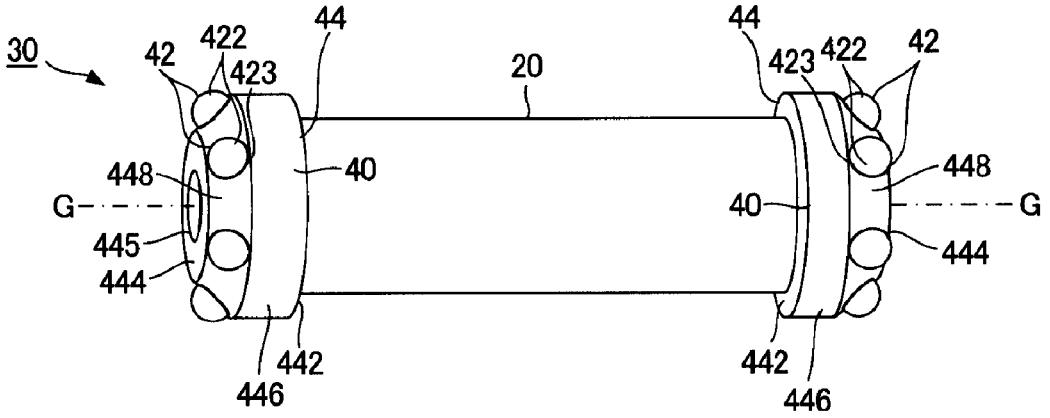
FIG. 8 is an external perspective view illustrating configuration of a medium holder according to a third modified example of the first embodiment.

FIG. 8 is an external perspective view illustrating configuration of a medium holder 30 according to a third modified example of the first embodiment. The medium holder 30 of FIG. 8 is a member in which an inclined face 448 that intersects both the end face 444 and the side face 446 is formed to the end face 444 of the flange portion 44, and rotating bodies 422 are provided to this inclined face 448. According to the third modified example, the medium holder 30 can be moved whether vertically oriented or horizontally oriented since the rotating bodies 422 abut the floor D whether the medium holder 30 is vertically oriented or horizontally oriented.

Figure 9:
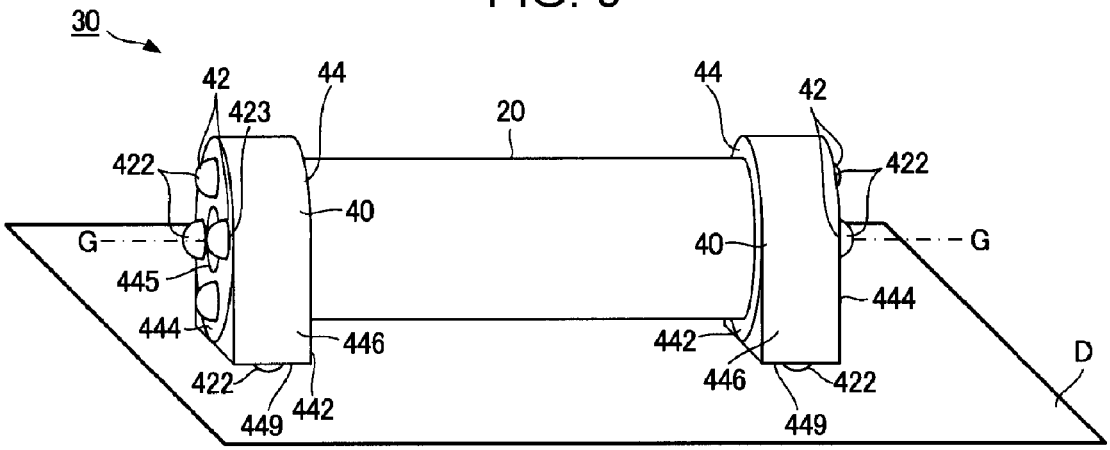
FIG. 9 is an external perspective view illustrating configuration of a medium holder according to a fourth modified example of the first embodiment.
Figure 10:
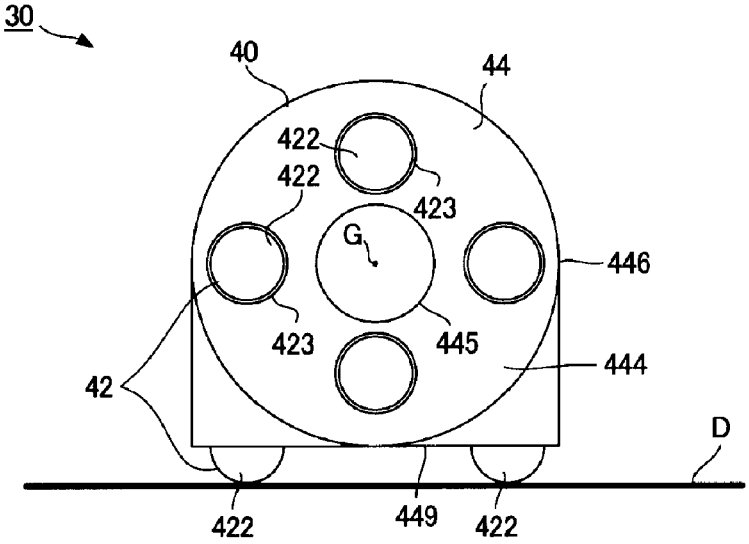
FIG. 10 is a diagram of the medium holder of FIG. 9, as viewed along an axial direction.

FIG. 9 and FIG. 10 are diagrams illustrating configuration of a medium holder 30 according to a fourth modified example of the first embodiment. FIG. 9 is an external perspective view of the medium holder 30 according to the fourth modified example. FIG. 10 is a diagram of the medium holder 30 of FIG. 9, as viewed along the G-G axial line direction. The medium holder 30 illustrated in FIG. 9 and FIG. 10 is a member in which a plane portion 449 that is level with respect to the floor D is formed to a portion of the side face 446 of the flange portion 44, and rotating bodies 422 are disposed at this plane portion 449. According to the fourth modified example, since the rotating bodies 422 of the end face 444 abut the floor D when vertically oriented, and the rotating bodies 422 of the plane portion 449 abut the floor D when horizontally oriented, the medium holder 30 can be moved whether vertically oriented or horizontally oriented.

Second Embodiment

Figure 11:
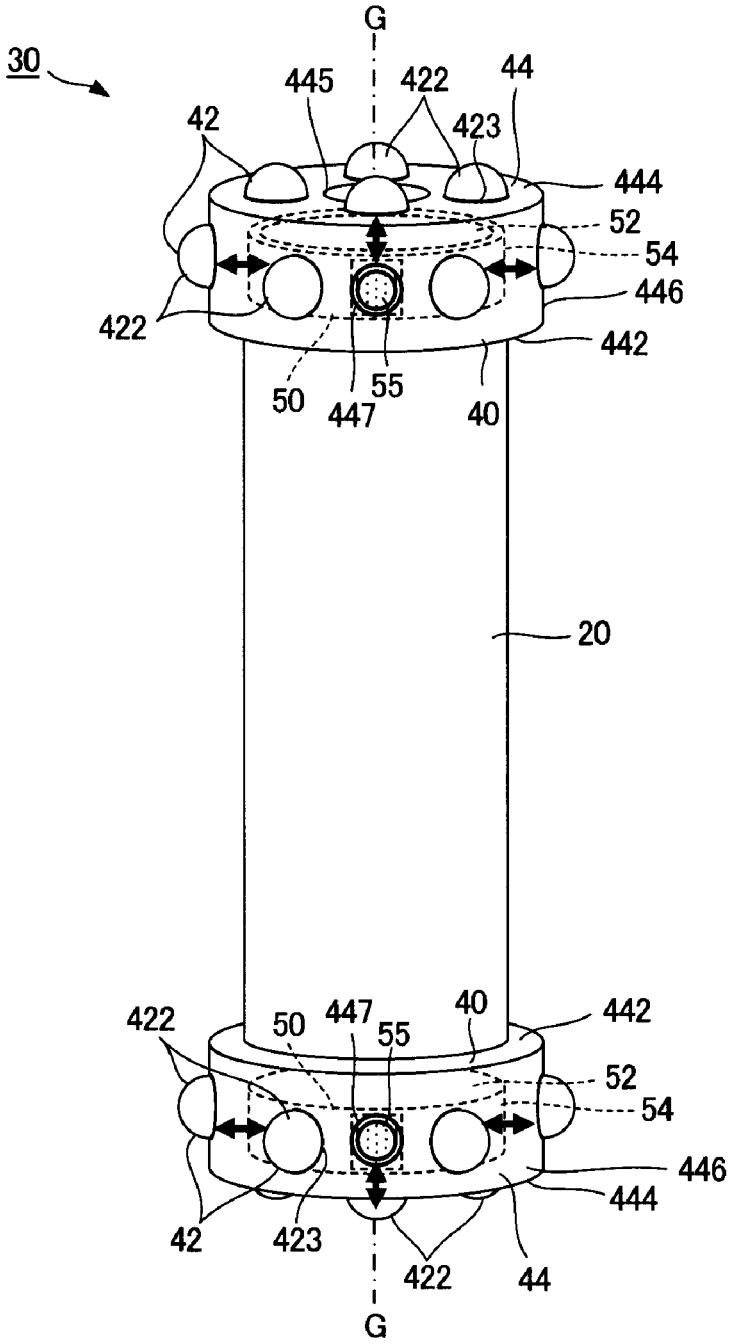
FIG. 11 is an external perspective view illustrating configuration of a medium holder according to a second embodiment.

Explanation follows regarding a second embodiment of the invention. In the following embodiments, elements having similar operation or functionality to that of the first embodiment use the reference numerals employed in the explanation of the first embodiment, and respective detailed explanation thereof is omitted as appropriate. FIG. 11 is an external perspective view of configuration illustrating a medium holder 30 according to the second embodiment.

In the configuration of FIG. 11, lock mechanisms 50 that lock the rotating bodies 422 are provided to the movement mechanisms 42 of the medium holder 30 of the first embodiment. A lock mechanism 50 is provided inside each flange. The lock mechanism 50 includes a circular plate member 52 for locking the rotating bodies 422 of the end face 444, and a circular tube member 54 for locking the rotating bodies 422 of the side face 446. The circular plate member 52 is provided so as to be capable of moving along the G-G axial line direction, between a position that abuts and locks the rotation of every rotating body 422 of the end face 444 and, and a position that is away from the rotating bodies 422 of the end face 444 and that releases the locking. An outer circumferential face of the circular tube member 54 is provided so as to be capable of moving along a direction intersecting the G-G axial line direction (a peripheral direction), between a position that abuts and locks the rotation of every rotating body 422 of the side face 446, and a position that is away from the rotating bodies 422 of the side face 446 and that releases the locking.

The circular plate member 52 and the circular tube member 54 are driven by a lock release button 55 provided to the side face 446 of the flange portion 44. When the lock release button 55 is not being pushed down, the circular plate member 52 and the circular tube member 54 are in a position locking the rotating bodies 422. When the lock release button 55 is pushed down, the circular plate member 52 and the circular tube member 54 move to a position releasing the locking of the rotating bodies 422.

A movable mechanism (not illustrated in the drawings) is provided to the circular plate member 52 and the circular tube member 54. The rotating bodies 422 adopt a locked state or a lock-released state according to the operation of the movable mechanism. To be more specific, for example, a spring, not illustrated in the drawings, is provided on the inside of the circular plate member 52 and the circular tube member 54. In the locked state, the circular plate member 52 and the circular tube member 54 are pushed out toward the outside by the biasing force of the spring so as to cause contact with the rotating bodies 422, thereby fixing the rotating bodies 422 with friction therefrom, and achieving the locked state. A gear is provided to the inside of the lock release button 55. The gear rotates when the lock release button 55 is pushed in. A string is wound around the gear, and the string is connected to the circular plate member 52 and the circular tube member 54. When the lock release button 55 is pushed in, the string is wound on the gear, and the circular plate member 52 and the circular tube member 54 are respectively pulled back to the inside and separated from the rotating bodies 422, thereby releasing the locking.

Figure 12:
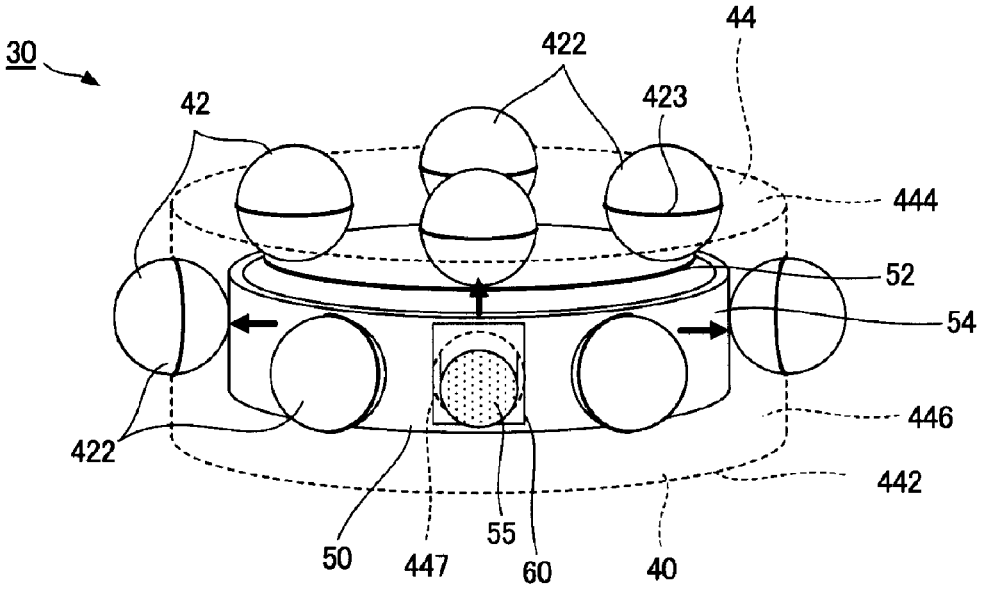
FIG. 12 is an explanatory operation diagram illustrating a locked state of the medium holder of FIG. 11.
Figure 13:
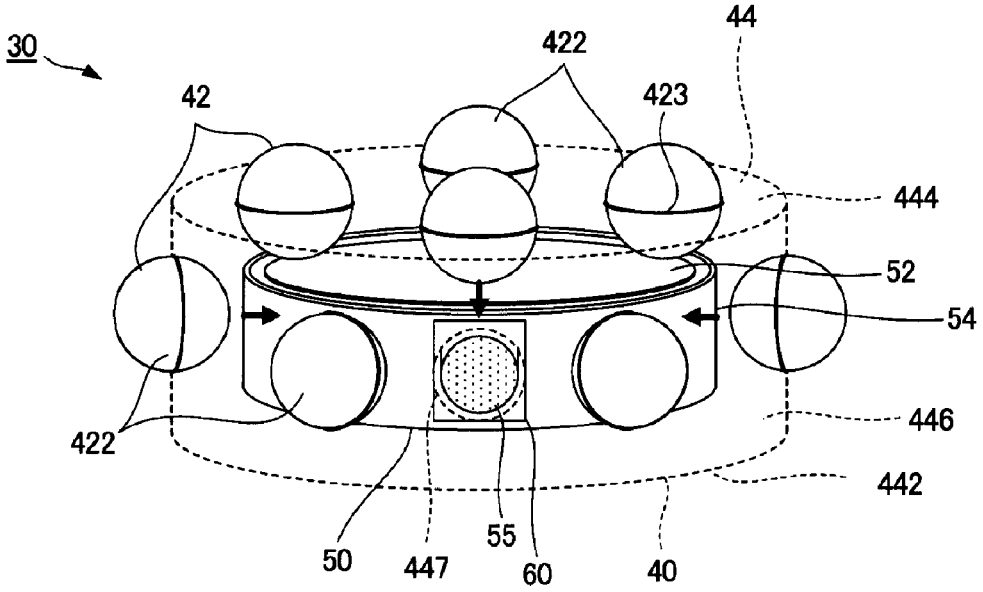
FIG. 13 is an explanatory operation diagram illustrating a lock-released state of the medium holder of FIG. 11.

FIG. 12 and FIG. 13 are diagrams explaining operation of the medium holder 30 of FIG. 11, and are diagrams in which one of the flange portions 44 has been enlarged. FIG. 12 illustrates a state in which the rotating bodies 422 are locked (the locked state), and FIG. 13 illustrates a state in which the locking of the rotating bodies 422 has been released (the lock-released state). Note that in FIG. 12 and FIG. 13, the flange portion 44 is illustrated by a dotted line to make the inside easier to see.

As illustrated in FIG. 12, when the lock release button 55 is not being pushed down, the circular plate member 52 and the circular tube member 54 abut and lock the rotating bodies 422. Movement of the medium holder 30 is thereby restrained. In contrast thereto, as illustrated in FIG. 13, when the lock release button 55 is pushed down, the circular plate member 52 and the circular tube member 54 move away from the rotating bodies 422 and the locking is released. Movement of the medium holder 30 thus becomes possible.

Figure 14:
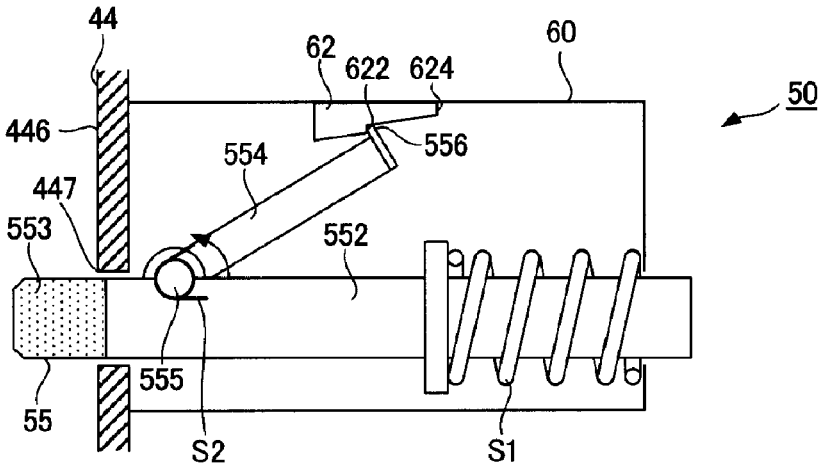
FIG. 14 is a diagram illustrating a locked state of a lock release button.
Figure 15:
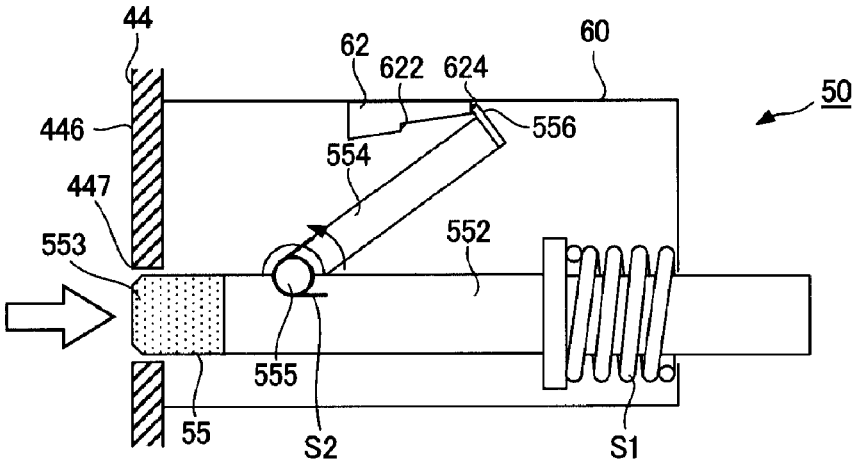
FIG. 15 is a diagram illustrating a lock-released state of a lock release button.
Figure 16:
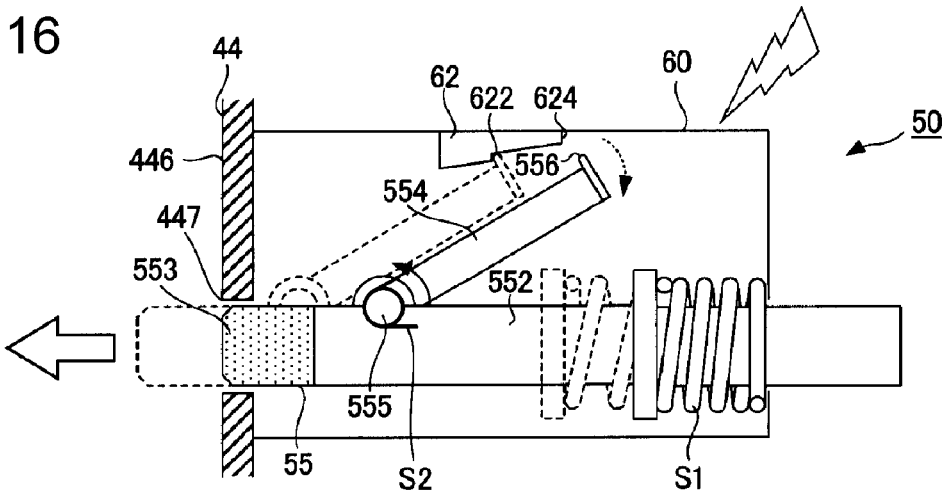
FIG. 16 is a diagram illustrating a process of forcing a lock release button to transition from a lock-released state to a locked state.

FIG. 14 to FIG. 16 are diagrams for explaining the configuration and operation of the lock release button 55. FIG. 14 illustrates a locked state, and FIG. 15 illustrates a lock-released state. FIG. 16 illustrates a process forcing transition from the lock-released state to the locked state when an impact force is received in a fall or the like.

As illustrated in FIG. 14, the lock release button 55 is configured by a movable shaft 552 and a leading end portion 553. The lock release button 55 is housed in a case 60 provided at the inside of the side face 446 such that the leading end portion 553 is capable of projecting from and retracting into a hole 447 in the side face 446. A base end of the lock release button 55 is coupled to a movable mechanism (not illustrated in the drawings) that moves the circular plate member 52 and the circular tube member 54 described above. A spring S1, which provides a bias in the direction that the leading end portion 553 projects out from the hole 447, is provided to the base end side of the lock release button 55.

An anchor member 62 that anchors the lock release button 55 is provided inside the case 60. The anchor member 62 is formed with a first step portion 622 that anchors the lock release button 55 in the locked state, and a second step portion 624 that anchors the lock release button 55 in the lock-released state. A link 554 capable of rotating about a swing portion 555 is provided to the movable shaft 552 of the lock release button 55. A leading end of the link 554 is provided with an anchor portion 556 that anchors to the anchor member 62. A spring S2, which provides a bias in the direction that the anchor portion 556 is pushed against the anchor member 62, is provided to the swing portion 555 of the link 554.

According to the lock mechanism 50 thus configured, when the lock release button 55 is in the locked state of FIG. 14, the anchor portion 556 of the link 554 is anchored to the first step portion 622 of the anchor member 62 in a state in which the leading end portion 553 projects out from the hole 447. Accordingly, the locked state of the rotating bodies 422 is maintained, and movement of the medium holder 30 is restricted. In the locked state of FIG. 14, when the leading end portion 553 of the lock release button 55 is pushed down, the lock release button 55 transitions to the lock-released state of FIG. 15. Namely, the anchor portion 556 of the link 554 moves and is anchored to the second step portion 624 of the anchor member 62 accompanying the lock release button 55 being pressed down. Accordingly, the locked state of the rotating bodies 422 is released, and movement of the medium holder 30 becomes possible.

In the lock-released state of FIG. 15, when, for example, the medium holder 30 falls over and receives an impact force greater than or equal to a specific threshold value, the anchor portion 556 of the link 554 momentarily comes off from the second step portion 624 of the anchor member 62 due to the impact force, as illustrated by solid lines in FIG. 16. Accordingly, the anchor portion 556 of the link 554 returns to the first step portion 622 of the anchor member 62 and is anchored thereto due to the biasing force of the spring S1 and the spring S2, as illustrated by the dotted lines in FIG. 16. Thus, the rotating bodies 422 are forced into the locked state, and movement of the medium holder 30 is restricted. The specific threshold value to force transition to the locked state can be adjusted by the biasing force of the spring S1 and the spring S2.

Note that the configuration of the anchor member 62 is not limited to that described above. For example, configuration may be made such that in the lock-released state of FIG. 15, when the lock release button 55 is further pressed in by a finger, the anchor portion 556 of the link 554 momentarily comes off from the second step portion 624 of the anchor member 62, and the lock release button 55 returns to the first step portion 622 and is anchored thereto when the finger is removed. Thus, when in the lock-released state of FIG. 15, pressing the lock release button 55 in with a finger and then removing the finger enables transition back to the locked state of FIG. 14.

Thus, according to the second embodiment, the normal state is the locked state. When movement of the medium holder 30 is desired, it is possible to transition to the lock-released state and achieve safety since pressing down the lock release button 55 enables transition to the lock-released state and maintenance of the lock-released state. In the lock-released state, it is also possible to force transition to the locked state when the medium holder 30 falls over and receives an impact force. Accordingly, since movement of the medium holder 30 can be forcibly restricted when the medium holder 30 has fallen over, safety can be increased.

Third Embodiment

Figure 17:
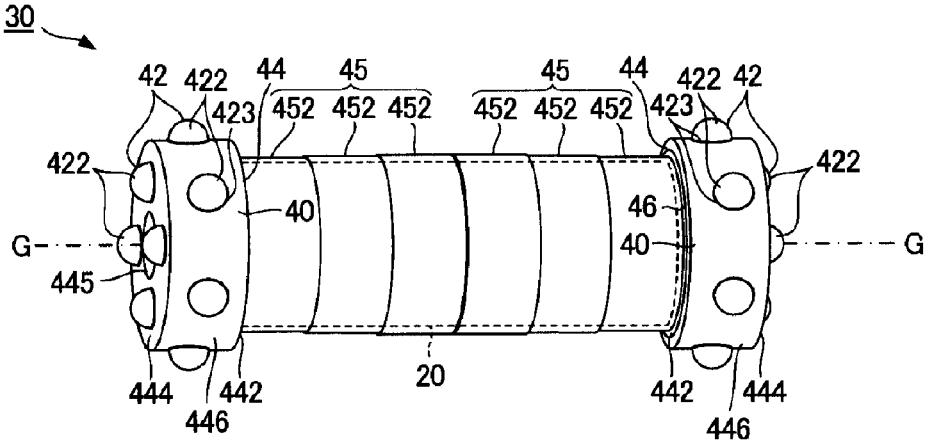
FIG. 17 is an external perspective view illustrating configuration of a medium holder according to a third embodiment.

Explanation follows regarding a third embodiment of the invention. FIG. 17 is an external perspective view illustrating configuration of a medium holder 30 according to the third embodiment. In the configuration of FIG. 17, a cover 45 that covers the medium roll 20 is provided to the medium holder 30 of the first embodiment. The cover 45 is formed from plural circular tube shaped cover members 452 that cover the medium roll 20, and the cover 45 is capable of being housed in the medium holder units 40. The cover 45 of FIG. 17 is formed from six cover members 452. Each medium holder unit 40 is provided with a circular tube shaped housing portion 46. Three of the cover members 452 are stacked and housed in each housing portion 46. Each of the three cover members 452 housed in the medium holder unit 40 is capable of sliding against the other overlapping cover members 452.

Figure 18:
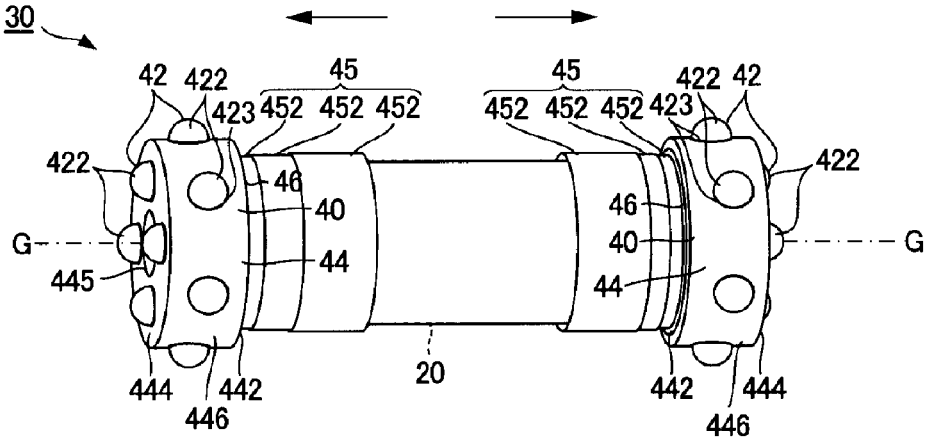
FIG. 18 is an explanatory operation diagram illustrating a process of storing the cover of FIG. 17.
Figure 19:
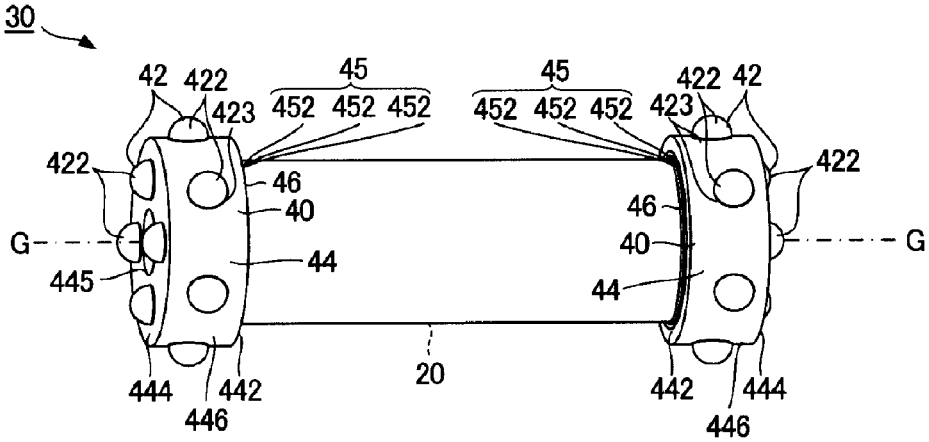
FIG. 19 is an explanatory operation diagram illustrating a state after storing the cover of FIG. 17.

FIG. 18 and FIG. 19 are diagrams explaining operation of the cover 45 of FIG. 17. FIG. 18 is an explanatory operation diagram illustrating a process of storing the cover 45, and FIG. 19 is an explanatory operation diagram illustrating a state after storing the cover 45 of FIG. 17. As illustrated in FIG. 18, the cover members 452 are respectively stacked in the direction of the arrows, and the cover members 452 are housed in the respective medium holder units 40 as illustrated in FIG. 19. Accordingly, as the cover members 452 can be taken out from the respective medium holder units 40 so as to cover the medium roll 20 during handling or storage, dust or the like can be suppressed from adhering to the medium roll 20. Moreover, as the cover members 452 can be housed in the respective medium holder units 40 when mounting the medium holder 30 in a liquid ejecting apparatus, the medium 22 can be pulled out from the medium roll 20 and transported. Note that the number and shape of the cover members 452 are not limited to that illustrated in the third embodiment.

Fourth Embodiment

Figure 20:
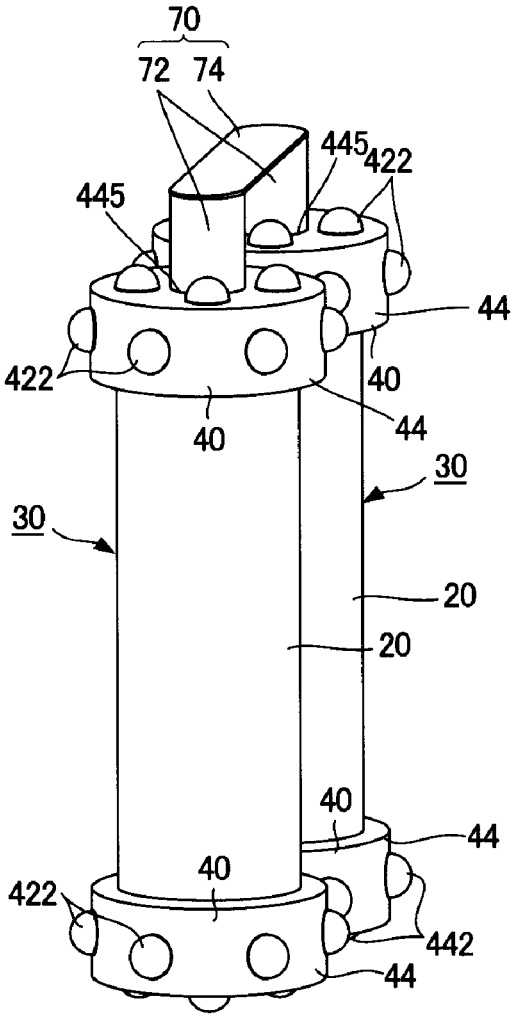
FIG. 20 is an external perspective view illustrating configuration of a medium holder according to a fourth embodiment.

Explanation follows regarding a fourth embodiment of the invention. FIG. 20 is an external perspective view illustrating configuration of medium holders 30 according to the fourth embodiment. FIG. 20 illustrates a configuration in which plural of the medium holder 30 of the first embodiment are coupled together by a coupling member 70. The coupling member 70 couples together plural of the medium holder units 40 mounted onto respective medium rolls 20. The coupling member 70 of FIG. 20 includes two insertion portions 72, and a coupling portion 74 that couples these insertion portions 72 together. Each of the insertion portions 72 is inserted into a shaft hole 445 of the medium holder unit 40 of the respective medium holder 30. According to the thus configured coupling member 70 of FIG. 20, two of the medium holders 30 can be coupled together. Note that by increasing the number of insertion portions 72, the coupling member 70 can couple three or more medium holders 30 together. According to the fourth embodiment, plural medium holders 30 can be moved at once while in a coupled state.

Fifth Embodiment

Figure 21:
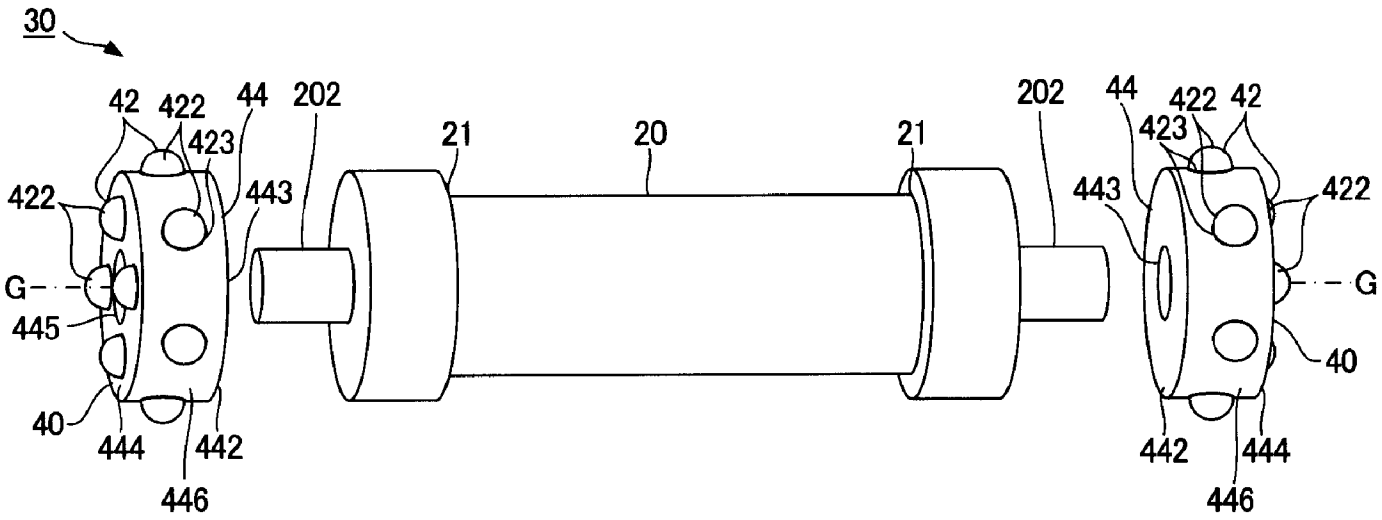
FIG. 21 is an external perspective view illustrating configuration of a medium holder according to a fifth embodiment.

Explanation follows regarding a fifth embodiment of the invention. FIG. 21 is an external perspective view illustrating configuration of a medium holder 30 according to the fifth embodiment. Although, examples have been given of cases in which the support shafts 111 for mounting the medium roll 20 to the medium mounting portions 11 are provided to the medium mounting portions 11 in the first embodiment to the fourth embodiment, in the fifth embodiment, an example is given of a case in which support shafts 202 for mounting the medium roll 20 to the medium mounting portions 11 are provided to the medium roll 20.

A support shaft 202 is provided to both end portions 21 of the medium roll 20 of FIG. 21. The end face 442 of the flange portion 44 of the medium holder units 40 of FIG. 21 is formed with an insertion hole 443 in place of the shaft portion 43 of FIG. 2. The support shafts 202 are inserted into the insertion holes 443, and the respective medium holder units 40 are mounted onto both end portions 21 of the medium roll 20 of FIG. 21. According to such a fifth embodiment, as the medium holder units 40 may also be mounted onto a medium roll 20 provided with the support shafts 202, the medium roll 20 is able to be easily moved. In cases in which the medium roll 20 of the fifth embodiment is to be mounted onto the medium mounting portions 11, the support shafts 202 of the medium roll 20 are mounted onto the medium mounting portions 11 after removing the medium holder units 40.

Note that the first embodiment to the fifth embodiment may be combined as appropriate within a range in which there are no mutual inconsistencies, and each of the modified examples of the first embodiment may also be applied to the second embodiment to the fifth embodiment.

Other Modified Examples

The exemplary embodiments given above may be modified in various ways. Specific modified embodiments are given below. Two or more aspects freely chosen from the following examples may be combined within a range in which there are no mutual inconsistencies.

(1) In each embodiment described above, an example was given of a serial head in which a carriage, onto which plural liquid ejecting heads 19 have been installed, is repeatedly moved to and fro along the X direction. However, the invention can also be applied to a line head in which plural liquid ejecting heads 19 are arranged across the entire width of the medium 22. Moreover, the method by which the liquid ejecting heads 19 eject ink is not limited to the method employing piezoelectric elements described above (a piezo method). For example, the invention can also be applied to a method in which liquid ejecting heads employ heating elements that generate bubbles in the pressure chambers using heat such that the pressure inside the pressure chambers varies (a thermal method).

(2) The printing apparatus in each of the embodiments given above can be applied not only to a machine dedicated to printing, but also to various other machines such as facsimile machines and copiers. The liquid ejecting apparatus of the invention is not limited to printing applications. For example, a liquid ejecting apparatus that ejects a colorant liquid can be employed as a manufacturing apparatus to form color filters for liquid crystal display apparatuses. Moreover, a liquid ejecting apparatus that ejects an electrode material liquid can be employed as a manufacturing apparatus to form wiring and electrodes on wiring substrates.

The entire disclosure of Japanese Patent Application No. 2016-045570, filed Mar. 9, 2016 is expressly incorporated by reference herein.

What is claimed is:

1. A medium holder comprising:
a medium roll being a wound medium; and
a medium holder unit that is mounted onto an end portion of the medium roll in an axial direction, the medium holder unit including a movement mechanism having a rotating body that moves the medium roll.

2. The medium holder according to claim 1, wherein
the movement mechanism includes the rotating body provided at a position at which the rotating body moves the medium roll in at least one of a direction intersecting the axial direction of the medium roll and a direction along the axial direction.

3. The medium holder according to claim 2, wherein
the rotating body is provided to at least one of an end face and a side face of the medium holder unit.

4. The medium holder according to claim 1, wherein
the movement mechanism is provided with a lock mechanism that locks the rotating body.

5. The medium holder according to claim 4, wherein
the lock mechanism locks the rotating body when the medium holder receives an impact force of a specific threshold value or greater.

6. The medium holder according to claim 1, further comprising
a cover that covers the medium roll, wherein the cover is housed in the medium holder unit.

7. The medium holder according to claim 1, further comprising
a coupling member that couples together medium holder units mounted onto each of a plurality of medium rolls.

8. The medium holder according to claim 1, wherein
the rotating body is configured from a shock absorbing material.

9. The medium holder according to claim 1, wherein
the rotating body is provided through a shock absorbing mechanism.

10. A liquid ejecting apparatus comprising:
a medium mounting portion onto which the medium holder of claim 1 is mounted;
a transport mechanism that pulls the medium out from the medium holder and transports the medium; and
a liquid ejecting head that ejects a liquid onto the medium transported by the transport mechanism.

11. A liquid ejecting apparatus comprising:
a medium mounting portion onto which the medium holder of claim 2 is mounted;
a transport mechanism that pulls the medium out from the medium holder and transports the medium; and
a liquid ejecting head that ejects a liquid onto the medium transported by the transport mechanism.

12. A liquid ejecting apparatus comprising:
a medium mounting portion onto which the medium holder of claim 3 is mounted;
a transport mechanism that pulls the medium out from the medium holder and transports the medium; and
a liquid ejecting head that ejects a liquid onto the medium transported by the transport mechanism.

13. A liquid ejecting apparatus comprising:
a medium mounting portion onto which the medium holder of claim 4 is mounted;
a transport mechanism that pulls the medium out from the medium holder and transports the medium; and
a liquid ejecting head that ejects a liquid onto the medium transported by the transport mechanism.

14. A liquid ejecting apparatus comprising:
a medium mounting portion onto which the medium holder of claim 5 is mounted;
a transport mechanism that pulls the medium out from the medium holder and transports the medium; and
a liquid ejecting head that ejects a liquid onto the medium transported by the transport mechanism.

15. A liquid ejecting apparatus comprising:
a medium mounting portion onto which the medium holder of claim 6 is mounted;
a transport mechanism that pulls the medium out from the medium holder and transports the medium; and
a liquid ejecting head that ejects a liquid onto the medium transported by the transport mechanism.

16. A liquid ejecting apparatus comprising:
a medium mounting portion onto which the medium holder of claim 7 is mounted;

a transport mechanism that pulls the medium out from the medium holder and transports the medium; and a liquid ejecting head that ejects a liquid onto the medium transported by the transport mechanism.

17. A liquid ejecting apparatus comprising:

a medium mounting portion onto which the medium holder of claim 8 is mounted;

a transport mechanism that pulls the medium out from the medium holder and transports the medium; and a liquid ejecting head that ejects a liquid onto the medium transported by the transport mechanism.

18. A liquid ejecting apparatus comprising:

a medium mounting portion onto which the medium holder of claim 9 is mounted;

a transport mechanism that pulls the medium out from the medium holder and transports the medium; and a liquid ejecting head that ejects a liquid onto the medium transported by the transport mechanism.

* * * * *